US005194838A

United States Patent [19]

Cobo

[11] Patent Number: 5,194,838

[45] Date of Patent: Mar. 16, 1993

[54] LOW-TORQUE MICROWAVE COAXIAL CABLE WITH GRAPHITE DISPOSED BETWEEN SHIELDING LAYERS

[75] Inventor: Bruce R. Cobo, Phoenix, Ariz.

[73] Assignee: W. L. Gore & Associates, Inc., Newark, Del.

[21] Appl. No.: 797,851

[22] Filed: Nov. 26, 1991

[51] Int. Cl.[5] ..... H01P 3/06

[52] U.S. Cl. ..... 333/243; 174/28

[58] Field of Search ..... 333/243, 236; 174/28, 174/36, 102 P

[56] References Cited

U.S. PATENT DOCUMENTS

| | | | |
|---|---|---|---|
| 2,322,773 | 6/1943 | Peters | 333/243 X |
| 2,622,152 | 12/1952 | Rosch | 333/243 |
| 3,339,007 | 8/1967 | Blodgett | 174/36 X |
| 3,692,925 | 9/1972 | Kindij | 174/36 X |
| 4,059,724 | 11/1977 | Ide | 174/36 |
| 4,641,110 | 2/1987 | Smith | 333/243 X |
| 4,642,417 | 2/1987 | Ruthrof et al. | 174/36 |
| 4,822,950 | 4/1989 | Schmitt | 174/36 |
| 4,871,883 | 10/1989 | Guiol | 333/243 X |

*Primary Examiner*—Paul M. Dzierzynski
*Assistant Examiner*—Benny T. Lee
*Attorney, Agent, or Firm*—Gary A. Samuels

[57] ABSTRACT

A low-torque microwave cable in which interior metal layers are coated with graphite particles and a process for coating the interior layers with graphite while flexing the cable to reduce stiffness by two-thirds.

7 Claims, 2 Drawing Sheets

LOW-TORQUE MICROWAVE COAXIAL CABLE WITH GRAPHITE DISPOSED BETWEEN SHIELDING LAYERS

FIELD OF THE INVENTION

The invention relates to coaxial cables for transmission of microwave signals of the type having a microwave energy conductor surrounded by a polymeric dielectric insulation, a conductive layer over the insulation, and a polymeric protective jacket for use in applications requiring vey low bending or torque forces.

BACKGROUND OF THE INVENTION

Microwave transmission cables of the type having an insulated microwave conductor shielded by a conductive metal foil layer helically wrapped around the insulation, and a protective jacket often tend to be more stiff and thus less bendable without damage. There are a number of applications, most notably involving gimbal mechanisms, which require a microwave cable of this type, but one which is less stiff or more easily bent. These gimbal mechanisms often have limited drive power for movement, and each element in the mechanism must provide the minimum resistance to torque possible. The present invention provides a more limp and more easily bent microwave cable and a process for its manufacture.

SUMMARY OF THE INVENTION

The low-torque microwave coaxial cable of the invention comprises a metal conductor, preferably of stranded silver-plated copper, surrounded by a polymeric dielectric insulation, preferably comprising expanded polytetrafluoroethylene (PTFE). The insulated conductor is surrounded by a layer of conductive metal shielding helically wrapped around the insulated microwave conductor. A preferred metal is a foil of silver-plated copper, for example.

The helically-wrapped metal foil shielding is surrounded by a layer of metal braid to further shield the microwave conductor and to provide a strength member to the cable. Preferred materials for the braid include silver-plated copper, silver-plated steel, silver-plated copper clad steel, for example. A conductive strong polymer fiber may also be used as a braid material. A protective polymer jacket is usually applied to the cable outside the braid by extrusion or tape-wrapping.

The spaces between the layers of conductive metal foil wrapped around the insulation of the cable and between the strands of braiding and the foil layer contain particles of graphite to lubricate the metal-to-metal contact surfaces. The graphite particles are applied by passing the cable, at a stage in its manufacture before an outer impervious jacket has been applied, over and between a series of spaced-apart rollers submerged in a bath of graphite particles suspended in a liquid, preferably an alcohol such as isopropanol. The graphite may be thus applied to the cable, coated on the foil to be wrapped around the insulation, applied to the foil layer from the alcohol after the foil has been wrapped on the cable, or applied to the braid from the alcohol after the braid has been formed around the foil layer of the cable.

The cable is passed at least once, but more commonly several times through the series of rollers in the graphite/alcohol bath until no significant increase in limpness occurs from further rolling of the cable through the rollers. Simple tests of the stiffness of the cable are used to determine the number of passes through the rollers necessary to maximize the limpness of the cable. The number and size of the rollers and their distance apart also affect the flexing of the cable. It is undesirable to use more passes and flexing of the cable than necessary over smaller diameter rollers spaced further apart to achieve the desired limpness in the cable. These are the factors that effect breakdown of the structure of the cable. It is necessary to balance the factors that achieve limpness in the cable with those that could cause damage to the cable to achieve the desired limpness with minimal break down of the cable structure. Ideally, the signal-carrying properties of the cable are fully retained after the rolling process has been completed.

DETAILED DESCRIPTION OF THE INVENTION

The invention is now described with reference to the drawings to more clearly delineate the important details of the invention.

Figure 1:
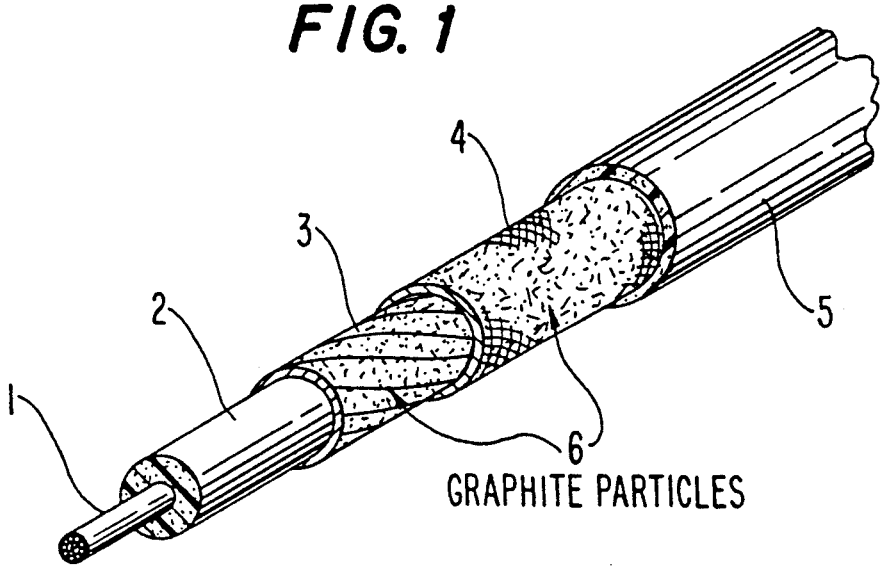
FIG. 1 is a perspective view of a cable of the invention with layers removed for better viewing of the structure of a cable of the invention.

FIG. 1 is a perspective view of a microwave cable of the invention with the layers partially removed for easy viewing of the structure of the cable. The center conductor 1 is of a conductive metal, preferably a noble-metal. A silver-plated copper conductor is preferred, most preferably a stranded silver-plated copper for a limp, easily bent cable. A silver-plated solid copper conductor may also be used where limpness is of less critical importance.

Conductor 1 is surrounded by a dielectric insulation useful in conducting microwave signals and is preferably a porous insulation such as expanded polytetrafluoroethylene (PTFE).

Expanded PTFE is a most preferred insulation and is fully described as to both composition and methods of manufacture in U.S. Pat. Nos. 3,953,566, 3,962,153, 4,096,227, 4,187,390, 4,478,665, 4,902,423, and 5,037,554, which are hereby incorporated by reference. Expanded PTFE is applied to a conductor by tape-wrapping helically around conductor 1 enough layers of expanded PTFE tape to form the desired thickness of insulation. The tape is usually sintered to a solid porous insulation following the tape-wrapping step.

Insulation 2 is surrounded by layers of conductive shielding 3, which may be a silver-plated copper foil or a metallized polymer tape wrap, applied helically around insulation 2. Insulation 3 is further surrounded by a braided conductive shield 4 of metal plated conductive wire or strips of foil, typically of preferred silver-plated copper, which has been found to be useful in microwave transmission. Silver-plated steel or silver-plated copper clad steel may also be used. The braided shield 4 and the cable as a whole is completed by an outer protective polymeric jacket 5, which may be of tape-wrapped expanded PTFE or other polymer tape or may be extruded from a thermoplastic polymer, such as polyvinyl chloride, polyethylene, polypropylene, polyurethane, or thermoplastic fluoropolymer resin. For the present invention, the jacket should be quite thin and of materials to form as limp a cable as possible commensurate with the other properties desired in the cable besides limpness.

On the metal surfaces of the foil or tape 3 and braid 4 are particles of graphite 6. Graphite 6 is applied from a bath of about 1 part of graphite in 50 parts of alcohol, usually isopropanol. The cable is passed through a stage of manufacture, before application of jacket 5 through, and around a set of rollers residing in a bath of graphite particles in alcohol. As the cable flexes back and forth among the rollers the particles of graphite work their way into the cable between the metal surfaces of metallized foil or tape 3 and the braid layers 1, thus lubricating those surfaces when the cable is thereafter bent. The cable flexed and treated with graphite in this manner is about two-thirds less stiff than before treatment and will require significantly less energy to bend it where the cable is regularly and systematically bent in use.

Figure 2:
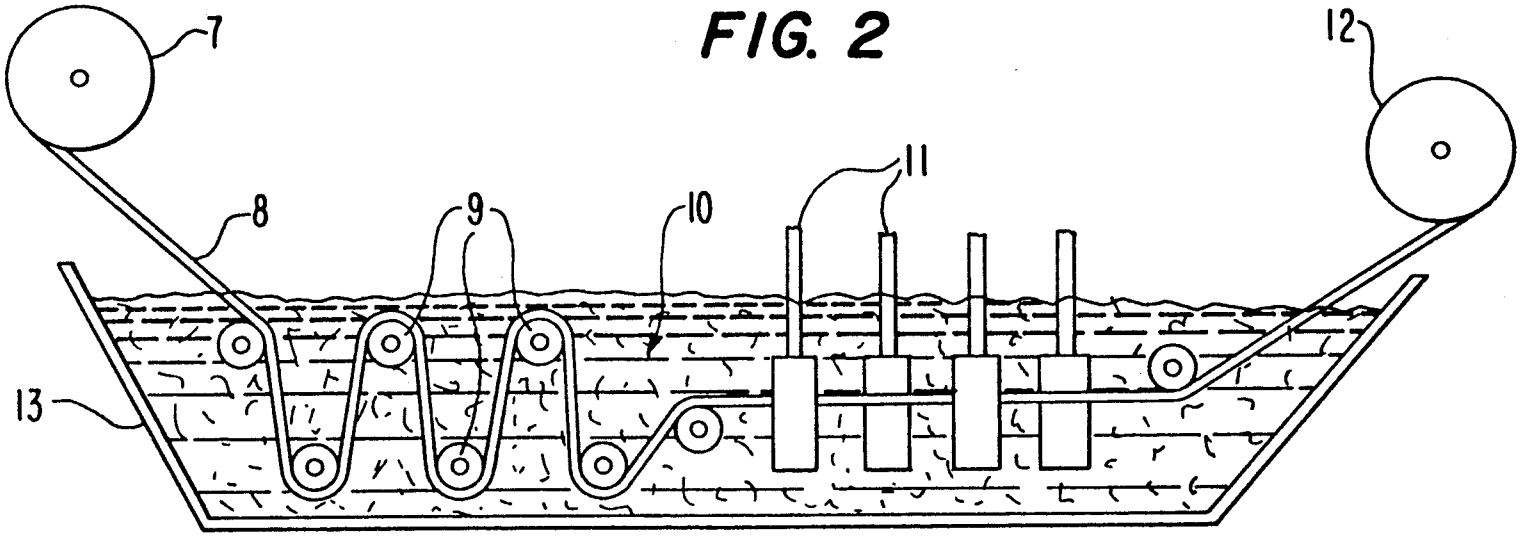
FIG. 2 is a schematic diagram of an apparatus used in the process of the invention.

FIG. 2 is a schematic diagram of the process of graphite application to a cable. A bath 10 comprising graphite particles in alcohol fills tray 13. The cable of the invention, before application of jacket 5, passes off storage reel 7 over a horizontal roller into bath 10 where it passes over and among horizontal rollers 9 and vertical rollers 11, flexing all the time it is moving in the bath. The flexed graphite impregnated cable is then taken up on storage reel 12. Rollers 9 and 11 may be adjusted to be closer to or further from each other to change the amount of flex applied to the cable in its passage through bath 10. It has been found that for each different cable being treated, a certain amount of flexing in the bath yields a minimum in the stiffness of the cable (or achieves maximum limpness), with further flexing tending to do more damage to the cable than yield additional limpness. There is thus usually a balance between adequate bending in the bath and limpness achieved thereby. A reasonably high concentration of graphite particles in the bath helps achieve a maximum degree of limpness with a minimum number of cable flexness between rollers during one or more passes of a cable through the rollers in the bath.

The graphite may be applied to the cable from the bath in several ways: coated on the shielding foil before application to the cable; placed on the foil after the foil has been applied to the cable; or on the braid after the braid has been applied to the cable.

The following table describes the results of testing a cable for stiffness after passing one or more times through a bath of 50 parts of graphite particles in 1 part of isopropanol.

| Cable | Taber Stiffness (w/out jacket) Torque (in. oz.) | Cable Stability Shake | Cable Stability Wiggle | Torque Watch with jacket in in. oz. | Stiffness w/out jacket in in. oz. |
|---|---|---|---|---|---|
| No Graphite | 100 | −0.02 | −0.01 | 2.85 | 2.1 |
| 1 Pass | 31 | −0.04 | −0.02 | 1.00 | 0.6 |
| 2 Passes | 28 | −0.15 | −0.04 | 0.08 | 0.5 |
| 3 Passes | 26 | −0.18 | −0.05 | 0.75 | 0.5 |

A Teledyne Taber Stiffness Tester, Model V-5 150-B, was used to measure Taber Stiffness in gram centimeters, which was converted to inch ounces. This tester is fully described in U.S. Pat. Nos. 2,465,180 and 2,063,275 and in operating manuals available from Teledyne Taber of North Tonananda, N.J. A Torque-Watch Stiffness Tester, provided by Waters Manufacturing Co. of Wayland, Mass. was also used for stiffness testing. The Torque-Watch instrument utilizes resistance to twisting a calibrated spring to measure stiffness (DES patent 177,889).

The cable of the invention is unexpectedly useful in applications where maximum limpness is useful, commensurate with retention of excellent microwave transmission properties, such as for supplying signals to cycling moving devices where minimum energy expenditure moving or bending the signal cable is desirable to help minimize weight or power requirements in the application.

I claim:

1. A microwave coaxial cable having low resistance to torque comprising:

(a) a metal center conductor surrounded by a polymeric dielectric insulation;

(b) a layer of conductive metal shielding surround said dielectric insulation;

(c) a layer of braided metal shielding surrounding said conductive shielding; and (d) a layer of protective polymeric jacketing surrounding said braided shielding;

(e) particles of graphite being positioned between the conductive metal shielding layer and the braided shielding layer on metal surfaces thereof.

2. A cable of claim 1 wherein said dielectric polymer insulation comprises expanded polytetrafluoroethylene.

3. A cable of claim 2 wherein said layer of conductive shielding comprises helically wound silver-plated copper foil.

4. A cable of claim 1 wherein said layer of conductive metal shielding comprises metal coated polymer tape.

5. A cable of claim 1 wherein said braided metal shielding comprises braided silver-plated metal strands.

6. A cable of claim 5 wherein the metal in said silver-plated metal is selected from the group consisting of copper, steel, and copper clad steel.

7. A cable of claim 3 wherein said center conductor, said layer of conductive shielding, and said braided metal shielding comprises silver-plated copper.

* * * * *